US005836407A

United States Patent [19]

Leroy

[11] Patent Number: 5,836,407

[45] Date of Patent: Nov. 17, 1998

[54] ARTICULATED TOOL FOR DRILLING OIL, GAS GEOTHERMAL WELLS

[76] Inventor: André Leroy, 64 chaussée du Roi Baudoin, Saint Symphorien, Belgium

[21] Appl. No.: 750,467

[22] PCT Filed: Jun. 14, 1995

[86] PCT No.: PCT/FR95/00779

§ 371 Date: Mar. 21, 1997

§ 102(e) Date: Mar. 21, 1997

[87] PCT Pub. No.: WO95/34741

PCT Pub. Date: Dec. 21, 1995

[30] Foreign Application Priority Data

Jun. 15, 1994 [FR] France ..... 94 07551

[51] Int. Cl.[6] ..... E21B 4/00; E21B 17/04

[52] U.S. Cl. ..... 175/101; 175/325.3; 175/327

[58] Field of Search ..... 175/101, 106, 175/320, 325.3, 327

[56] References Cited

U.S. PATENT DOCUMENTS 5,472,057 12/1995 Winfree ..... 175/101 X

FOREIGN PATENT DOCUMENTS

R77179 6/1962 France .
2190411 11/1987 United Kingdom .
2281577 3/1995 United Kingdom .

*Primary Examiner*—David J. Bagnell
*Attorney, Agent, or Firm*—William L. Feeney; Kerkam, Stowell, Kondracki & Clarke, P.C.

[57] ABSTRACT

The invention relates to a tool for drilling oil, gas or geothermic wells. The tool includes two main members, a hollow shaft (1) and a blind tool body (2) more elongate than conventional tool bodies; the two main members are spherically connected to each other by means of a ball joint (4,5). The ball joint is located at the very bottom of the blind portion of the tool body which carries a stabilizer (19) at the other end. The tool is also provided, between the hollow shaft and the tool body, with an appropriate transmission system (6, 7, 8, 9, 11), which is spaced apart from the ball joint and situated between the latter and the stabilizer. The essential advantage of the tool lies in the relative position of the ball joint and the stabilizer, the positioning conferring on the tool a favorable dynamic behavior, without risk of buttressing. Field of application: drilling of oil wells, gas wells and geothermic wells.

5 Claims, 1 Drawing Sheet

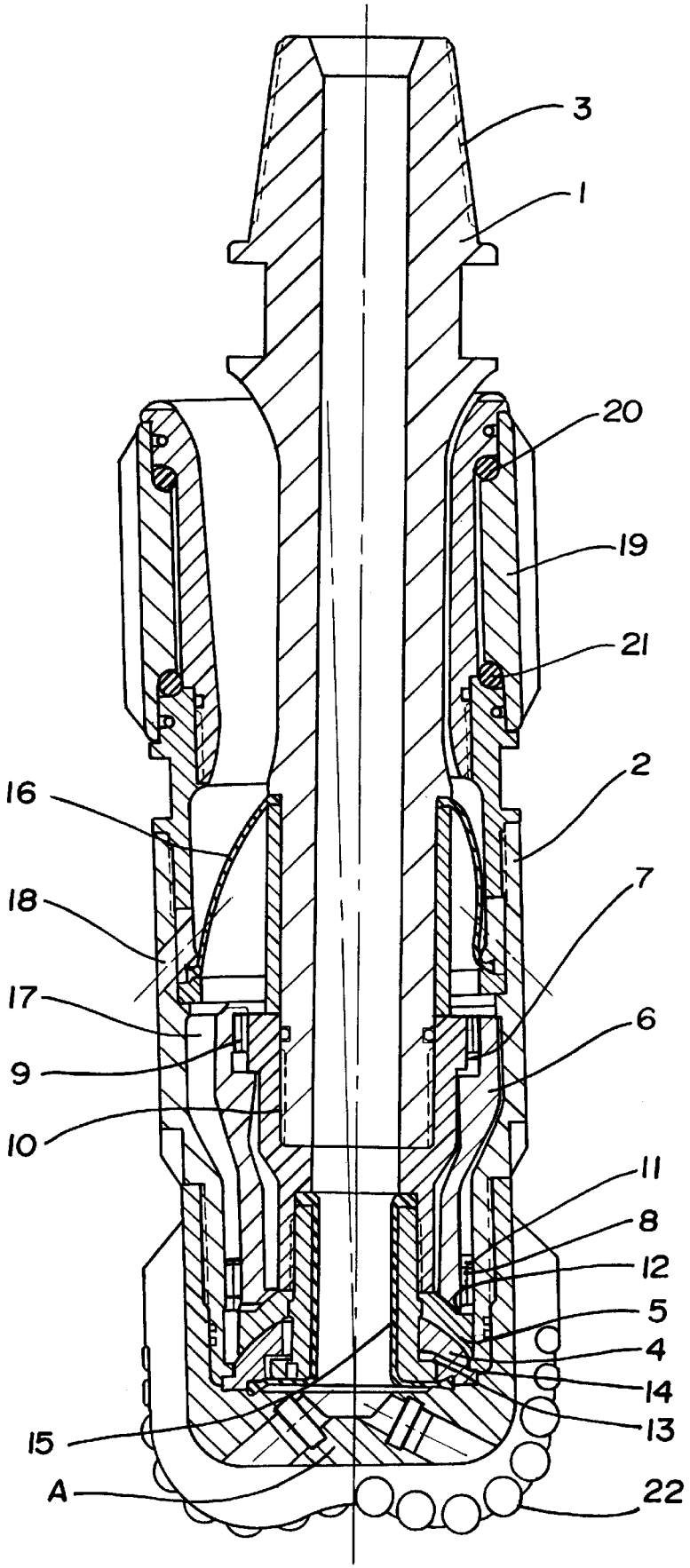
3
1
20
19
21
2
16
7
18
17
6
9
10
11
8
12
5
4
14
13
15
A
22

ARTICULATED TOOL FOR DRILLING OIL, GAS GEOTHERMAL WELLS

BACKGROUND OF THE INVENTION

FIELD OF THE INVENTION

The intention relates to a tool for drilling oil, gas or geothermal wells, driven in rotation either from the surface by a rotating system of drill rods and collars, or by an underground engine.

SUMMARY OF THE INVENTION

The tool is comprised of two main components. The first is a hollow shaft which is connected by one of its ends either to the last rod in the column, or to the shaft of the engine through which the drilling mud must be led. In either case, for purposes of unity of language, the rod or the shaft of the engine to which the hollow shaft belonging to the tool is connected will be called the "driving element." It is also through this driving element that the forward thrust is transmitted to the tool. The second main component of the tool is a blind tubular body, hereinafter called the "tool body," the closed end of which externally carries the cutting edges, and the open end of which allows the passage of the hollow body.

The main components are spherically connected, and this connection is provided by a ball joint; the common center of the two spherical surfaces that it places in contact is called the "center of the ball joint". The-existence of this spherical connection requires the use of a second connection which allows the drilling torque to be transmitted from the hollow shaft to the tool body while maintaining the relative clearances of these two components stemming from their spherical connection.

An articulated tool which corresponds to this definition exists in the prior art (patent GB-A-2.190.411). The tool described by this patent is designed for use in deviated drilling; because of this, the tool body is as short as possible, the ball joint is located above the tool body (GB-A-2.190.411), the hollow shaft is almost entirely outside the tool body and the transmission system is integrated into the ball joint, to the detriment of the area of the spherical contact surfaces.

The tool which is the subject of the present invention is preferably intended for drilling in a straight line. This tool has a relatively slender body, the ball joint is located at the very bottom of the blind end of the tool body, which carries a stabilizer at its other end, and the transmission system, which is separate from the ball joint, is located on the same side of this ball joint as the stabilizer. The distance between the center of the ball joint and the stabilizer, or more precisely between this center and the plane perpendicular to the axis of the tool situated at the mid-height of this stabilizer, must be at least on the order of 2.5 times the diameter of the tool body, and even greater when the lateral aggressiveness of the cutting edges of the tool is greater.

The transmission systems used in the tool which is the subject of the invention are distinguished from those used in the known articulated tools by the fact that they are outside the ball joint, and thus avoid reducing its supporting surfaces, and by the fact that they comprise, between the hollow shaft and the tool body, an intermediate element which surrounds the hollow shaft. This element is connected to each of the main components by a particular toothing when this element is rigid, or by a joint when it is deformable (flexible shell). In any case, it is called a "variable configuration" transmission.

Any comparison between the behavior of the tool which is the subject of the invention and the articulated tools cited in the prior art is difficult, since their preferred fields of application are different.

As compared to the known monolithic tools, the advantages offered by the tool which is the subject of the invention reside in its dynamic behavior. This behavior is rendered largely independent from the parasitic movements of the driving element, without this independence preventing the tool itself from reacting to the most troublesome vibrations caused by the cutting movement and without allowing its two main components to enter into a buttressing configuration. These advantages result from the relative position of the ball joint and the stabilizer belonging to the tool body.

Two possible cases of operation of the tool which is the subject of the invention will be considered.

In the first of these cases, it is assumed that the axis of the hollow shaft joined to the driving element is maintained by the latter along the axis of the well already drilled and that the tool, as a result of the cutting conditions it encounters, tends to begin a precession movement. The position of the center of the ball joint, with which the vertex of the precession cone is identified, allows the tool body to react spontaneously to the resultant inclination of the cutting force; this force itself tends to bring the tool body into coaxiality with the hollow shaft, with a sensitivity that increases the further the center of the ball joint is located from the contact surfaces of this ball joint, in the direction of the forward movement of the tool. In this case, the action of the stabilizer prevents the relative inclination of the tool from becoming enough to create a contact between the hollow shaft and the tool body at the open end of the latter before the spontaneous reaction of the tool has occurred.

In the second case considered, a deformation of the driving element is assumed to cause the axis of the hollow shaft to be inclined relative to the axis of the well. In this case the axis of the hollow shaft relative to the axis of the well describes a cone, the vertex of which coincides with the center of the ball joint. The tool body tends to follow the hollow shaft in this movement, but the stabilizer prevents it from doing so, in a way that is particularly effective if the stabilizer is in rotoid connection with the tool body: the latter then continues to progress along the axis of the well, independently from the disturbed movement that the deformed driving element is imposing on the hollow shaft.

The position of the ball joint at the very end of the tool body makes it possible to place the center of this ball joint as far away as possible in the direction of the forward movement without excessively weakening the lateral guiding power of the spherical connection. But this spherical connection becomes unilateral, and an alternate contact must therefore be provided between the two main components of the tool in order to allow the tool to be lowered and raised without the risk of losing the body.

By thus placing the center of the ball joint as far away as possible in the direction indicated, the dynamic behavior of the tool is improved and the distance between the center of the ball joint and the stabilizer is increased for a given slenderness of the tool body.

When the contact surfaces in the ball joint and in the transmission system are metallic, lubrication of these surfaces is essential not only for their preservation, but in order to reduce friction stress in these contacts, which can cause the behavior of the tool to deviate from its ideal behavior. Therefore, if necessary, it is possible to isolate between the tool body and the hollow shaft a lubricating chamber which contains the ball joint and the variable configuration transmission system. This chamber is limited by a deformable double seal system which enables the relative movements of the tool body and the hollow shaft allowed by the ball joint and makes it possible to maintain the enclosed lubricant at a pressure near that of the flow of drilling mud rising toward the surface.

BRIEF DESCRIPTION OF THE DRAWINGS

The sole FIGURE shows, by way of a non-limiting example, a drilling tool according to the invention.

DESCRIPTION OF THE PREFERRED EMBODIMENTS

The partial section presented in this FIGURE shows the two main components which constitute the tool: the hollow shaft 1 and the tool body 2 in a blind tubular shape, which carries at its closed end the cutting-tips such as 22. The hollow shaft 1 is joined at one of its ends to the driving element, not represented, by means of the tapered thread 3. At its other end, the hollow shaft 1 is spherically connected to the tool body 2 by a ball joint, located in the closed end of the tool body and constituted by the element 4 which carries the male surface and is integral with the tool body as well as by the element 5 which carries the female surface and is integral with the hollow shaft. The male and female contact surfaces, which are in conformity in the ball joint, are centered on the point A which is called the center of the ball joint. The hollow shaft 1 and the tool body 2 are also connected by the sleeve 6 which has an internal spur toothing 7 and an external rounded toothing 8. The internal spur toothing 7 of the sleeve meshes with the external rounded toothing 9 with the same number of teeth, machined on the part 10 integral with the hollow shaft, and the external rounded toothing 8 of the sleeve meshes with the internal spur toothing 11, with the same number of teeth, integral with the tool body. This second connection between the hollow shaft and the tool body therefore exists in the form of a deformable coupling, the sleeve 6 having am additional point contact through the surface 12 with the part 5 of the ball joint, so as to limit toward the front the absolute translation of the sleeve.

Since in this case the spherical connection produced by the ball joint 4, 5 is unilateral, that is apt to transmit from the hollow shaft to the tool body a thrust which acts only in the direction of the forward movement, a substitute contact is provided between the surface 13 linked to the hollow shaft and the surface 14 linked to the tool body during the lowering or the raising of the tool in order to allow, during these operations, the transmission of a thrust which acts from the hollow shaft to the tool body in the direction opposite that in which the ball joint can transmit.

Two sealing systems, which respectively use the membranes 15 and 16, isolate from the drilling mud, between the hollow shaft and the tool body, an oil chamber 17 containing the lubricant essential to the ball joint and to the coupling.

The membrane 15 (front membrane), which in the free state has the shape of a tube carrying a flange at one of its ends, is engaged by its tube-shaped part in the internal surface of the hollow shaft and by its flange-shaped part in the tool body. This membrane, which separates the descending mud flow (at high pressure) from the lubricant contained in the oil chamber, conforms to metal surfaces over the largest part of its area, and is free on an area of its surface just large enough for it to have the necessary deformability for the relative clearance of the hollow shaft relative to the tool body during the operation of the tool, and during its raising or lowering, so as to allow the surfaces 13 and 14 to come into contact.

The membrane 16 (rear membrane), which in the free state has the shape of a truncated cone, is attached by the perimeter of its small base to the external surface of the hollow shaft, and by the perimeter of its large base to the internal surface of the tool body, in such a way that the small base is situated on the side of the open part of the tool body. Lateral openings such as 18 are cut into the tool body, at the height of the membrane 16, in order to lead to this location the rising mud flow inside the tool body, and thereby to create, along the rear surface of the membrane, a sweeping effect which prevents any sedimentation of hard bodies in proximity to this membrane.

The tool comprises a stabilizer 19 near the open end of the tool body. In the embodiment illustrated here, this stabilizer 19 is in rotoid connection with the tool body by means of rolling bearings 20 and 21, lubricated separately with grease during assembly and maintenance.

I claim:

1. A tool for drilling oil, gas or geothermal wells, driven in rotation by a driving element which also transmits to it a forward thrust, constituted by two main components, one of which is a hollow shaft joined by one of its ends to the driving element, and the other of which is a blind tubular body, here called the tool body, the closed end of which externally carries the cutting edges and the open end of which allows the passage of the hollow shaft, in which the two main components are spherically connected, characterized:

in that the hollow shaft transmits the drilling torque to the tool body through a transmission system called a variable configuration transmission system comprising, between the hollow shaft and the tool body, an intermediate element connected to each of the main components, in that a ball joint which embodies the spherical connection is located at the very bottom of the blind part of the tool body, in that the tool body carries a stabilizer located at its other end, at a distance from the center of the ball joint on the order of at least 2.5 times the external diameter of the tool body, in that the variable configuration transmission system is separate from the ball joint and located on the same side of this ball joint as the stabilizer and in that this system uses, to transmit the drilling torque, the intermediate element and wherein the intermediate element surrounds the hollow shaft.

2. The drilling tool according to claim 1 characterized in that the spherical connection located at the bottom of the tool body is unilateral so that it only transmits, from the hollow shaft to the tool body, a thrust acting in the direction of the forward movement, the center of the ball joint thus being able to be placed as far away as possible in the direction of the forward movement.

3. The drilling tool according to claim 1, characterized:

in that the variable configuration transmission system is constituted by a sleeve contained in the tool body, which carries at one of its ends an internal spur toothing and at the other end an external rounded toothing, in that the internal spur toothing of this sleeve meshes with an external rounded toothing, with the same number of teeth, integral with the tool body and in that the external rounded toothing of the sleeve meshes with an internal spur toothing, with the same number of teeth, integral with the tool body, so as to constitute a deformable coupling between the hollow shaft and the tool body, an additional point contact of the sleeve on one of the main components of the tool unilaterally limiting the absolute translation of the sleeve without thereby restricting the relative clearances.

4. The drilling tool according to claim 1, characterized in that the stabilizer located near the open end of the tool body is in rotoid connection with the tool body.

5. The drilling tool according to claim 1, characterized in that a deformable double seal system isolates, between the hollow shaft and the tool body, an oil chamber which contains the ball joint and a transmission joint, and in that this double seal system is constituted by a front membrane, which in the free state has the shape of a tube carrying a flange at one of its ends, the tube-shaped part of this membrane being engaged in an internal surface of the hollow shaft and the flange being engaged in the tool body, and a rear membrane, which in the free state has the shape of a truncated cone and which is attached in an external surface of the hollow shaft and in the internal surface of the tool body, in such a way that the small base of the truncated cone is located on the side of the open part of the tool, and in that the tool body, at the height of the rear membrane, has openings which allow the rising mud flow to be led inside the tool body, creating along the rear membrane a sweeping effect which prevents the sedimentation of hard particles between the rear membrane and the tool body.

* * * * *